US011885068B2

(12) United States Patent
Duan et al.

(10) Patent No.: US 11,885,068 B2
(45) Date of Patent: Jan. 30, 2024

(54) ENCAPSULATED DUCT CABLE WITH IDENTIFICATION TAGS AND MANUFACTURING METHOD THEREOF

(71) Applicant: Shinda (Tangshan) Creative Oil & Gas Equipment Co., LTD., Tangshan (CN)

(72) Inventors: Jianliang Duan, Tangshan (CN); Jian Dong, Tangshan (CN)

(73) Assignee: Shinda (Tangshan) Creative Oil & Gas Equipment CO., LTD.

( * ) Notice: Subject to any disclaimer, the term of this patent is extended or adjusted under 35 U.S.C. 154(b) by 698 days.

(21) Appl. No.: 17/035,920

(22) Filed: Sep. 29, 2020

(65) Prior Publication Data

US 2021/0355633 A1 Nov. 18, 2021

(30) Foreign Application Priority Data

May 12, 2020 (CN) ..... 202010397053.7

(51) Int. Cl.
*D07B 1/14* (2006.01)
*D07B 7/16* (2006.01)

(52) U.S. Cl.
CPC ..... *D07B 1/141* (2013.01); *D07B 7/167* (2013.01); *D07B 2205/2003* (2013.01); *D07B 2205/502* (2013.01); *D07B 2207/4031* (2013.01)

(58) Field of Classification Search
CPC ..... D07B 1/141; D07B 1/148; D07B 1/16; D07B 1/14; D07B 7/145; D07B 7/167;
(Continued)

(56) References Cited

U.S. PATENT DOCUMENTS

2013/0312863 A1* 11/2013 Pellegrini ..... F16L 58/1063 138/140
2014/0130928 A1* 5/2014 Drouin ..... E21B 17/006 138/104

(Continued)

FOREIGN PATENT DOCUMENTS

CN 110544560 A * 12/2019 ..... E21B 47/00
KR 200329939 Y1 * 10/2003 ..... F16L 5/02

OTHER PUBLICATIONS

SAF-2507 Super Duplex Tubing Datasheet_Sandvik_1 to 18_Jan 2017.*

*Primary Examiner* — Timothy J Thompson
*Assistant Examiner* — Guillermo J Egoavil
(74) *Attorney, Agent, or Firm* — IP Attorneys Group, LLC

(57) ABSTRACT

The present invention discloses an encapsulated duct cable with identification tags and a manufacturing method thereof. The logging encapsulated duct cable comprises an encapsulation layer. The cross section of the encapsulation layer is polygonal or arc-shaped. At least one cable protective tube and at least one oil-liquid tube are arranged in the encapsulation layer. A cable is arranged in the cable protective tube. Identification tags with different color identifiers are respectively arranged on one side of the cable protective tube and one side of the oil-liquid tube in one to one correspondence. The manufacturing method of the logging encapsulated duct cable mainly comprises three steps of machining the cable protective tube and paving the cable pavement, machining the oil-liquid tube, and machining the encapsulation layer. The present invention has double functions of conveying the oil and the liquid and transmitting the data.

4 Claims, 5 Drawing Sheets

(58) Field of Classification Search
CPC .... D07B 2201/2083; D07B 2205/2003; D07B 2205/502; D07B 2207/4031; E21B 47/00; E21B 47/12; H01B 7/185; H01B 7/2806; H01B 7/363; H01B 7/366; H01B 11/00; H01B 13/22
USPC ..... 174/68.1
See application file for complete search history.

(56) References Cited

U.S. PATENT DOCUMENTS

2014/0261845 A1* 9/2014 Nagy ..... F16L 33/01 138/137
2016/0310920 A1* 10/2016 Brown ..... B01F 25/31

* cited by examiner

ENCAPSULATED DUCT CABLE WITH IDENTIFICATION TAGS AND MANUFACTURING METHOD THEREOF

This application claims priority to Chinese Non-Provisional Patent Application No.: 202010397053.7, filed May 12, 2020, and titled "Encapsulated Duct Cable with Identification Tags and Manufacturing Method Thereof." The contents of the above-identified Application are relied upon and incorporated herein by reference in its entirety.

TECHNICAL FIELD

The present invention relates to the technical field of logging cables, and in particular to an encapsulated duct cable with identification tags and a manufacturing method thereof.

BACKGROUND

A logging cable can be applied to not only operations of logging, perforating, coring and the like in various oil and gas wells, but also hydraulic and hydrologic survey, coalfield geological exploration, geothermal logging and the like. It is a connection line utilized as load-bearing connection between the ground system and underground instruments and utilized for transmitting survey data.

At present, the operating condition of the logging cable in the oil well is harsh. The logging cable is usually located in a high-temperature high-pressure environment which contains corrosive mediums such as oil, gas and the like. Furthermore, limited by the narrow internal space of the oil well casing, the logging cable is easy to bend or corrode in the mounting process. In addition, some hydraulic devices in the oil well should be communicated with the ground through tubes. In the prior art, the logging cable and the oil-liquid tubes are separately arranged, which wastes materials. If there are thousands, even millions, of meters of the cable and the tube, how to improve the resistances to pressure, tension and corrosion of the logging cable and integrate the conveying tubes in the oil well is a problem urgently to be solved.

SUMMARY

The objective of the present invention is to provide an encapsulated duct cable with identification tags and a manufacturing method thereof. The logging encapsulated duct cable has high resistances to pressure, tension and corrosion and also has double functions of conveying the oil and the liquid and transmitting the data.

To solve the above-mentioned technical problem, the present invention adopts the following technical solution:

An encapsulated duct cable with identification tags of the present invention comprises an encapsulation layer. The cross section of the encapsulation layer is polygonal or arc-shaped. At least one cable protective tube and at least one oil-liquid tube are arranged in the encapsulation layer. A cable is arranged in the cable protective tube.

Identification tags with different color identifiers are respectively arranged on one side of the cable protective tube and one side of the oil-liquid tube in one to one correspondence.

Further, the identification tag is a rope or a narrow band.

Further, the encapsulation layer is made from a thermoplastic material. The cable protective tube is made of an 825 steel tube. The oil-liquid tube is made of a 2507 steel tube.

Further, the cable comprises a jacket, an insulation layer and a core which are sequentially arranged from exterior to interior.

Further, the jacket is made from the polypropylene (PP). The insulation layer is made from the fluorinated ethylene propylene (FEP) copolymer.

A manufacturing method of an encapsulated duct cable with identification tags comprises the following steps:

- step 1: machining a cable protective tube and paving a cable: placing a steel coil raw material for producing the cable protective tube on a steel band winding device; placing a wound cable on a cable winding device; guiding the start end of the steel coil raw material to sequentially pass through a steel tube initial forming device, the cable winding device, a steel tube laser welding device, a nondestructive testing device, a steel tube drawing device and a traction device to produce the cable protective tube sleeving the cable;
- winding the cable protective tube by a cable protective tube winding device for later use;
- step 2: machining an oil-liquid tube: placing a steel coil raw material for producing the oil-liquid tube on the steel band winding device; guiding the start end of the steel coil raw material to sequentially pass through a steel tube forming device, the steel tube laser welding device, an outer bur removing device, the steel tube drawing device, an annealing furnace and the nondestructive testing device to produce the oil-liquid tube;
- winding the oil-liquid tube by an oil-liquid tube winding device for later use;
- step 3: machining an encapsulation layer: placing the cable protective tube and the oil-liquid tube, which need to be encapsulated, on a relative winding device; guiding the start ends of the cable protective tube and the oil-liquid tube to sequentially pass through a steel tube straightening device, a steel tube preheating device, an identification tag winding device, an encapsulation and extrusion device, a cooling device and a traction device to form the encapsulation layer;
- winding the encapsulated duct cable by the winding device.

Further, the steel coil raw materials for producing the cable protective tube and the oil-liquid tube are degreased by utilizing alkaline hot water.

Further, the steel tube preheating device comprises a hot air blower and a preheating tube, which are communicated through a tube. Two ends of the preheating tube are connected with plugs in a sealing manner. Multiple tube through holes are formed in the center of the plug.

Further, the encapsulation and extrusion device comprises a die case and a die core, which match with each other in use. The die case is provided with a polygonal or arc-shaped encapsulation and extrusion opening. Multiple reserved guide holes are formed in the die core. The circumferential inner wall of each reserved guide hole is provided with a groove for guiding the identification tag.

Further, a tension device is arranged between the identification tag winding device and the encapsulation and extrusion device. The tension device comprises a base. Two guide pulleys and a support are arranged on the base. A lift arm is articulated with the support. One end of the lift arm is connected with the support through a tension spring, and the other end is provided with a tension pulley. The tension pulley is located between the two guide pulleys.

Compared with the prior art, the present invention has the following beneficial effects:

The present invention has double functions of conveying the oil and the liquid and transmitting the data. The encapsulation layer improves the corrosion resistance of the cable protective tube and the oil-liquid tube. To conveniently identify each cable protective tube or each oil-liquid tube, each identification tag has a unique color identifier. The identification tag can also be made from polyaromatic aramid synthetic fibers, Kevlar or a metal wire. By pulling the identification tag outwards, the identification tag cuts off the encapsulation layer covering the cable protective tube or the oil-liquid tube to expose the cable protective tube or the oil-liquid tube; then, the encapsulation layer or the oil-liquid tube can be connected with the device in the mine or on the ground.

BRIEF DESCRIPTION OF THE DRAWINGS

The present invention is further described below with reference to the accompanying drawings.

DESCRIPTION OF REFERENCE SIGNS

1—encapsulation layer, 2—protective tube, 3—oil-liquid tube, 4—cable, 401—jacket, 402—insulation layer, 403—core, 5—identification tag, 6—hot air blower, 7—preheating tube, 8—plug, 9—tube through hole, 10—die case, 1001—encapsulation and extrusion opening, 11—die core, 1101—reserved guide hole, 1102—groove, 12—tension device, 1201—base, 1202—guide pulley, 1203—support, 1204—lift arm and 1205—tension pulley.

DESCRIPTION OF THE EMBODIMENTS

To make persons skilled in the art better understand the technical solutions of the present invention, the following further describes the present invention in detail with reference to the accompanying drawings and specific embodiments.

Embodiment 1

Figure 1:
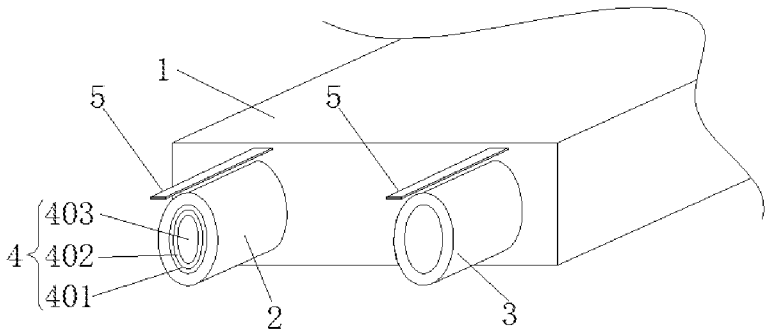
FIG. 1 is a schematic structural diagram of a logging encapsulated duct cable in Embodiment 1 of the present invention.

As shown in FIG. 1, the embodiment discloses an encapsulated duct cable with identification tags, comprising an encapsulation layer 1. The cross section of the encapsulation layer 1 is polygonal or arc-shaped. At least one cable protective tube 2 and at least one oil-liquid tube 3 are arranged in the encapsulation layer 1. A cable 4 is arranged in the cable protective tube 2. The encapsulation layer 1 protects the cable protective tube 2 to improve the corrosion resistance of the cable protective tube 2. The cable protective tube 2 has the high yield load so as to improve the whole resistances to pressure and tension. The oil-liquid tube 3 conveys the ground hydraulic oil/liquid to the mine and is communicated with a hydraulic device. In the embodiment, each cable protective tube 2 and the oil-liquid tube 3 are arranged side by side, and there is one cable protective tube 2 and one oil-liquid tube 3.

To conveniently identify each cable protective tube 2 and each oil-liquid tube 3, multiple identification tags 5 are arranged on one side of the cable protective tube 2 and one side of the oil-liquid tube 3. Each identification tag 5 is in one-to-one correspondence with each cable protective tube 2 or each oil-liquid tube 3. Each identification tag 5 has its unique color identifier. The identification tag 5 is a rope or a narrow band. In the embodiment, the identification tag 5 is the narrow band.

The identification tag 5 can also be made from polyaromatic aramid synthetic fibers, Kevlar or a metal wire. By pulling the identification tag 5 outwards, the identification tag 5 cuts off the encapsulation layer 1 covering the cable protective tube 2 or the oil-liquid tube 3 to expose the cable protective tube 2 or the oil-liquid tube 3; then, the encapsulation layer or the oil-liquid tube can be connected with the device in the mine or on the ground.

In the embodiment, the encapsulation layer 1 may be made from thermoplastic materials such as thermoplastic vulcanizate (TPV), polypropylene (PP), fluorinated ethylene propylene (FEP) and polyvinylidene fluoride (PVDF). The cable protective tube 2 is made of an 825 steel tube. The oil-liquid tube 3 is made of a 2507 steel tube.

The cable 4 is used for transmitting signals after connected with an underground instrument. The cable 4 comprises a jacket 401, an insulation layer 402 and a core 403 which are sequentially arranged from exterior to interior. In the embodiment, the jacket 401 is made from the polypropylene (PP). Further, the jacket 402 is made from the fluorinated ethylene propylene (FEP) copolymer. The jacket 401 can protect its coated object and has the functions of insulation, flame retardation, corrosion resistance, fixation and the like. The cable 4 is manufactured by a cable plastic extruder and belongs to the conventional manner, which can be implemented by those skilled in the art.

Figure 2:
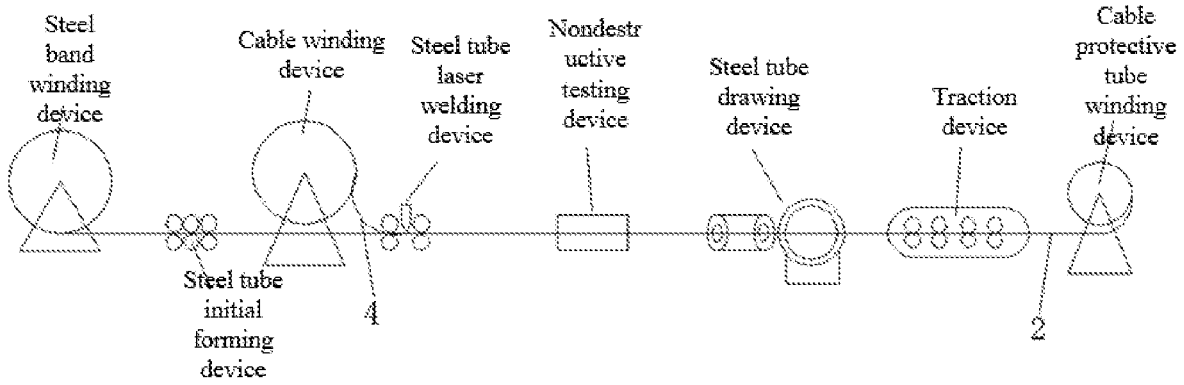
FIG. 2 is a flowchart of step 1 in Embodiment 1 of the present invention.
Figure 3:
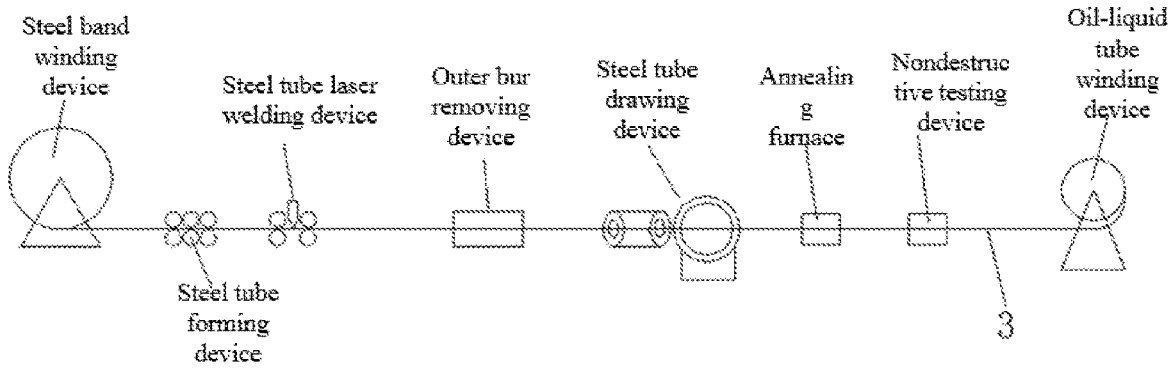
FIG. 3 is a flowchart of step 2 in Embodiment 1 of the present invention.
Figure 4:
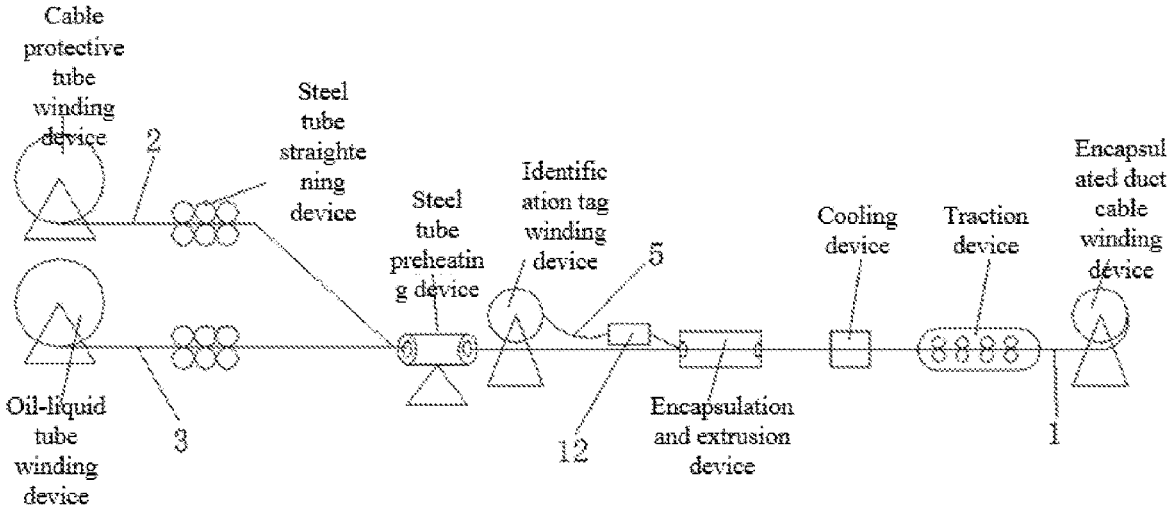
FIG. 4 is a flowchart of step 3 in Embodiment 1 of the present invention.

As shown in FIG. 2, FIG. 3 and FIG. 4, a manufacturing method of the encapsulated duct cable with identification tags comprises the following steps:

Step 1: Machining the cable protective tube and paving the cable: placing a steel coil raw material for producing the cable protective tube 2 on a steel band winding device; placing a wound cable 4 on a cable winding device; guiding the start end of the steel coil raw material to sequentially pass through a steel tube initial forming device, the cable winding device, a steel tube laser welding device, a nondestructive testing device, a steel tube drawing device and a traction device to produce the cable protective tube 2 sleeving the cable 4; winding the cable protective tube 2 by a cable protective tube winding device for later use.

The steel band is made in a U shape by the steel tube initial forming device. The cable 4 is placed into the cable protective tube 2 through an U-shaped opening. In the placing process, the cable needs to pass through a guide pulley. The guide pulley presses the cable 4 to approach the bottom surface of the cable protective tube 2 so as to prevent the cable 4 from being damaged by high temperature of laser welding. It should be noted that the steel band winding device, the cable winding device and the duct cable winding device are used for placing the raw materials, the semi-finished products and the finished products, and also used for paying off or taking up the materials. The laser welding device is used for welding an abutting slot of the cable protective tube 2. The nondestructive testing device conducts the nondestructive test on the welded cable protective tube 2 by using eddies. The drawing device draws the cable protective tube 2 to the desired size by using a preset specification of die. The drawing force is provided by a drawing gear device. The traction device provides the traction force for movement of the cable protective tube 2.

After the cable protective tube 2 is initially formed, its start end passes through the steel tube drawing device such that its tube diameter is changed. At this time, the steel tube drawing device stops, the start end of the cable 4 is placed in the initially formed cable protective tube 2. Then, the cable 4 is manually conveyed forwards till the start end of the cable 4 props against a shrunk position of the cable protective tube 2. The shrunk position of the cable protective tube 2 clamps the cable 4. At this time, the steel tube drawing device starts. The cable 4 follows the cable protective tube 2 to be drawn to move forwards.

Step 2: Machining the oil-liquid tube: placing a steel coil raw material for producing the oil-liquid tube on the steel band winding device; guiding the start end of the steel coil raw material to sequentially pass through a steel tube forming device, the steel tube laser welding device, an outer bur removing device, the steel tube drawing device, an annealing furnace and the nondestructive testing device to produce the oil-liquid tube 3;

winding the oil-liquid tube 3 by an oil-liquid tube winding device for later use.

Step 3: Machining the encapsulation layer: placing the cable protective tube 2 and the oil-liquid tube 3, which need to be encapsulated, on a relative winding device; guiding the start ends of the cable protective tube 2 and the oil-liquid tube 3 to sequentially pass through a steel tube straightening device, a steel tube preheating device, an identification tag winding device, an encapsulation and extrusion device, a cooling device and a traction device to form the encapsulation layer 1; winding the encapsulated duct cable by the winding device.

Figure 5:
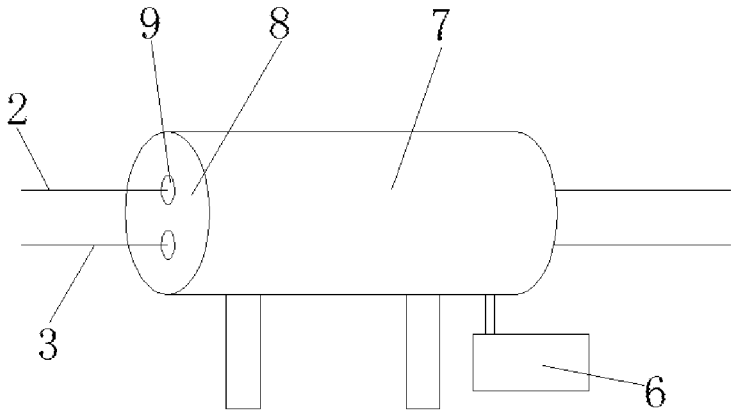
FIG. 5 is a schematic structural diagram of a steel tube preheating device in Embodiment 1 of the present invention.

The cable protective tube 2 and the oil-liquid tube 3 only needs to pass through one steel tube preheating device. As shown in FIG. 5, the steel tube preheating device comprises a hot air blower 6 and a preheating tube 7, which are communicated through a tube. Two ends of the preheating tube 7 are connected with plugs 8 in a sealing manner. Multiple tube through holes 9 are formed in the center of the plug 8. The cable protective tube 2 and the oil-liquid tube 3 pass through their corresponding tube through holes 9. The hot air blower 6 continuously blows the hot air into the preheating tube 7 to preheat the naked cable protective tube 2 and the oil-liquid tube 3.

Figure 6:
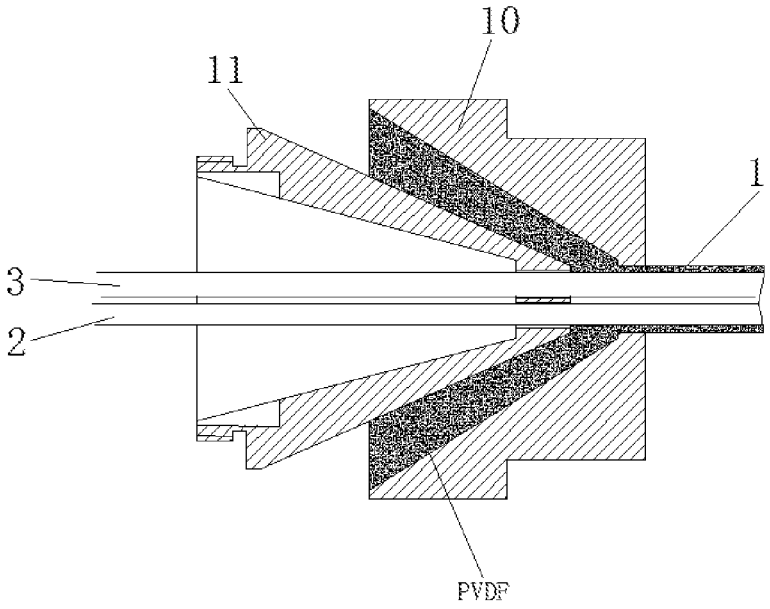
FIG. 6 is a schematic diagram showing a matching state of a die case and a die core in Embodiment 1 of the present invention.
Figure 7:
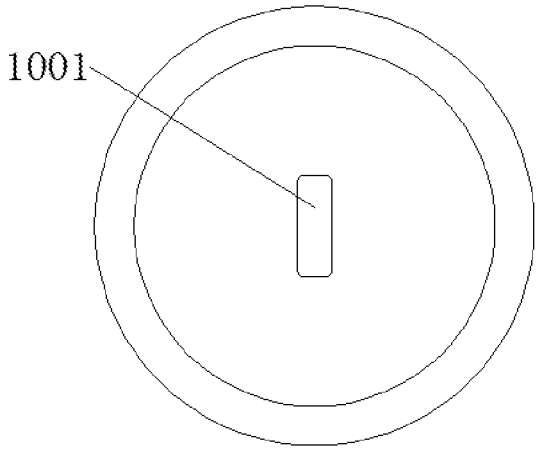
FIG. 7 is a right view of a die case in Embodiment 1 of the present invention.
Figure 8:
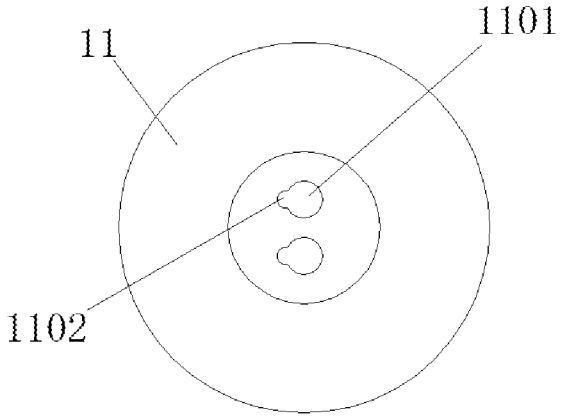
FIG. 8 is a right view of a die core in Embodiment 1 of the present invention.

As shown in FIG. 6 and FIG. 8, the encapsulation and extrusion device utilizes a wire and cable extruder, and its die utilizes an extrusion type die. The extrusion type die comprises a die case 10 and a die core 11, which match with each other in use. The die case 10 is provided with a polygonal encapsulation and extrusion opening 1001. Multiple reserved guide holes 1101 are formed in the die core 11. The cable protective tube 2 and the oil-liquid tube 3 pass through the corresponding reserved guide holes 1101. The circumferential inner wall of each reserved guide hole 1101 is provided with a groove 1102 for guiding the identification tag 5.

Figure 9:
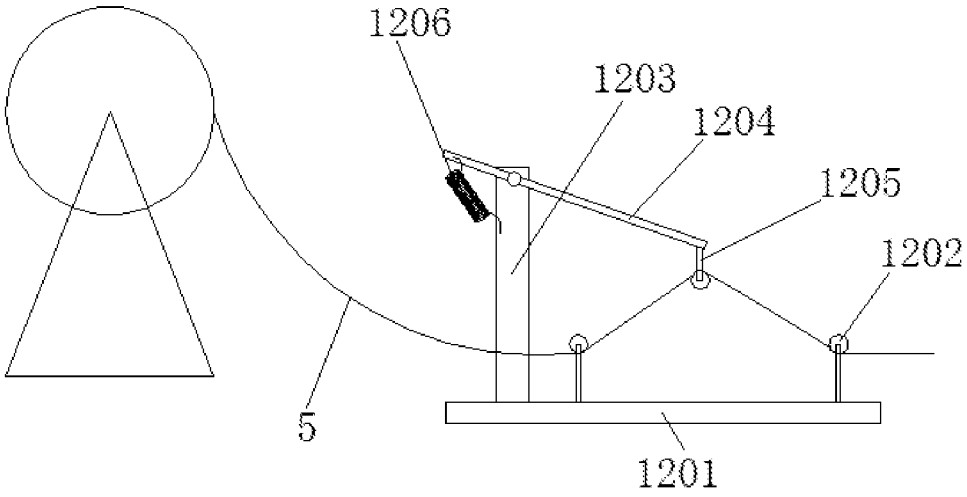
FIG. 9 is a schematic structural diagram of a tension device in Embodiment 1 of the present invention.

As shown in FIG. 9, a tension device 12 is arranged between the identification tag winding device and the encapsulation and extrusion device. The tension device 12 comprises a base 1201. Two guide pulleys 1202 and a support 1203 are arranged on the base 1201. A lift arm 1204 is articulated with the support 1203. One end of the lift arm 1204 is connected with the support 1203 through a tension spring 1206, and the other end of the lift arm 1204 is provided with a tension pulley 1205. The tension pulley 1205 is located between the two guide pulleys 1202.

To further supplement and optimize the above manufacturing method, the steel coil raw materials for producing the cable protective tube 2 and the oil-liquid tube 3 are degreased by utilizing alkaline hot water to remove impurities on the surface of the steel band.

It should be noted that the identification tag winding device is used for releasing the identification tag 5 along with the production line. The steel tube straightening device machines the wound duct cable to be a horizontal straight line through upper and lower pulleys. The encapsulation and extrusion device heats the PVDF grains at a corresponding temperature till the raw material is molten to be sol so as to have high plasticity. The cable protective tube 2 and the oil-liquid tube 3 pass through the extrusion device to form the encapsulation layer 1. After the cable protective tube 2 and the oil-liquid tube 3 are encapsulated and extruded, they enter a cold rinse bank to be cooled, solidified and molded. In the embodiment, the cold rinse bank is a cooling device.

Embodiment 2

Figure 10:
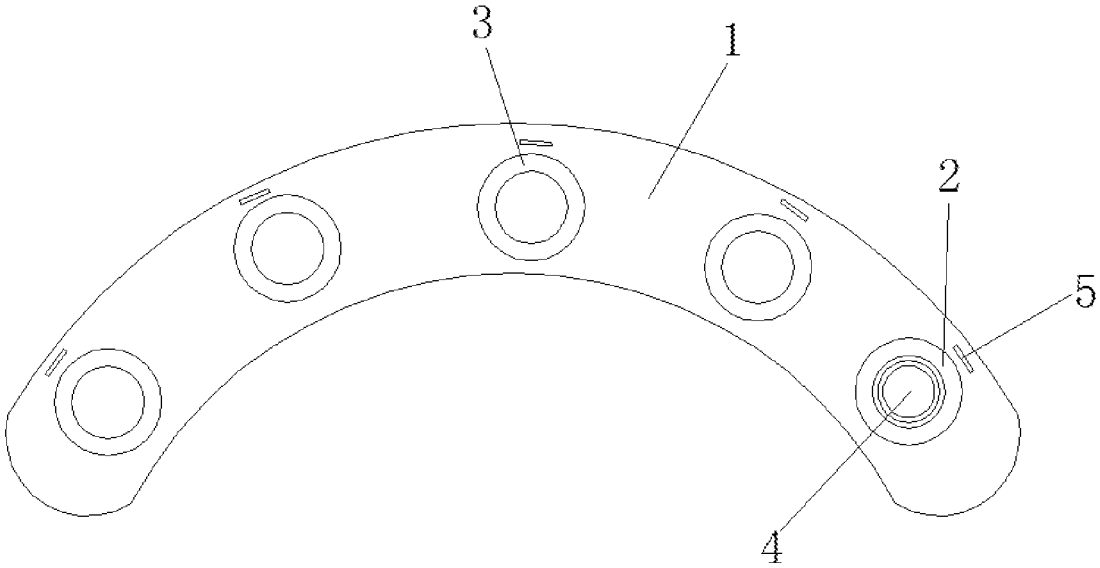
FIG. 10 is a schematic structural diagram of a logging encapsulated duct cable in Embodiment 2 of the present invention.

As shown in FIG. 10, the embodiment discloses an encapsulated duct cable with identification tags, comprising an encapsulation layer 1. At least one cable protective tube 2 and at least one oil-liquid tube 3 are arranged in the encapsulation layer 1. A cable 4 is arranged in the cable protective tube 2. Identification tags 5 with different color identifiers are respectively arranged on one side of the cable protective tube 2 and one side of the oil-liquid tube 3 in one to one correspondence. In the embodiment, the cross section of the encapsulation layer 1 is arc-shaped. The arc-shaped encapsulation layer 1 has a larger contact area with the continuous oil tube so as to reduce the friction and have better stability.

In its manufacturing method, the die case 10 is provided with a circular arc-shaped encapsulation and extrusion opening 1001. Multiple reserved guide holes 1101 on the die core 11 are also arranged in the shape of the circular arc. The other structures and manufacturing steps are totally the same as these in Embodiment 1, which are not described herein.

The above embodiments merely describe the preferred embodiments of the present invention and are not intended to limit the scope of the present invention. Various changes and improvements made to the technical solution of the present invention by those of ordinary skill in the art without departing from the design spirit of the present invention shall fall within the protective scope of the appended claims of the present invention.

What is claimed is:

1. A manufacturing method of an encapsulated duct cable with identification tags, the encapsulated duct cable comprising an encapsulation layer, wherein the cross section of the encapsulation layer is polygonal or arc-shaped; at least one cable protective tube and at least one oil-liquid tube are arranged in the encapsulation layer; a cable is arranged in the cable protective tube;

identification tags with different color identifiers are respectively arranged on one side of the cable protective tube and one side of the oil-liquid tube in one to one correspondence;

the manufacturing method comprising following steps:

step 1: machining the cable protective tube and paving the cable: placing a steel coil raw material for producing the cable protective tube on a steel band winding device; placing a wound cable on a cable winding device; guiding the start end of the steel coil raw material to sequentially pass through a steel tube initial forming device, the cable winding device, a steel tube laser welding device, a nondestructive testing device, a steel tube drawing device and a traction device to produce the cable protective tube sleeving the cable;

winding the cable protective tube by a cable protective tube winding device for later use;

step 2: machining the oil-liquid tube: placing a steel coil raw material for producing the oil-liquid tube on the steel band winding device; guiding the start end of the steel coil raw material to sequentially pass through a steel tube forming device, the steel tube laser welding device, an outer bur removing device, the steel tube drawing device, an annealing furnace and the nondestructive testing device to produce the oil-liquid tube;

winding the oil-liquid tube by an oil-liquid tube winding device for later use;

step 3: machining the encapsulation layer: placing the cable protective tube and the oil-liquid tube, which need to be encapsulated, on a relative winding device; guiding the start ends of the cable protective tube and the oil-liquid tube to sequentially pass through a steel tube straightening device, a steel tube preheating device, an identification tag winding device, an encapsulation and extrusion device, a cooling device and a traction device to form the encapsulation layer;

winding the encapsulated duct cable by the winding device;

wherein a tension device is arranged between the identification tag winding device and the encapsulation and extrusion device; the tension device comprises a base; two guide pulleys and a support are arranged on the base; a lift arm is articulated with the support; one end of the lift arm is connected with the support through a tension spring, and the other end of the lift arm is provided with a tension pulley; the tension pulley is located between the two guide pulleys.

2. The manufacturing method of the encapsulated duct cable with identification tags according to claim 1, wherein the steel coil raw materials for producing the cable protective tube and the oil-liquid tube are degreased by utilizing alkaline hot water.

3. The manufacturing method of the encapsulated duct cable with identification tags according to claim 1, wherein the steel tube preheating device comprises a hot air blower and a preheating tube, which are communicated through a tube; two ends of the preheating tube are connected with plugs in a sealing manner; multiple tube through holes are formed in the center of the plug.

4. The manufacturing method of the encapsulated duct cable with identification tags according to claim 1, wherein the encapsulation and extrusion device comprises a die case and a die core, which match with each other in use; the die case is provided with a polygonal encapsulation and extrusion opening; multiple reserved guide holes are formed in the die core; the circumferential inner wall of each reserved guide hole is provided with a groove for guiding the identification tag.

* * * * *